US011338952B2

(12) United States Patent
Vignali et al.

(10) Patent No.: US 11,338,952 B2
(45) Date of Patent: May 24, 2022

(54) LABELLING MACHINE FOR APPLYING LABEL SHEETS ONTO ARTICLES

(71) Applicant: Sidel Participations, Octeville-sur-mer (FR)

(72) Inventors: Matteo Vignali, Parma (IT); Nicola Veneziani, Parma (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 172 days.

(21) Appl. No.: 16/610,492

(22) PCT Filed: Aug. 24, 2017

(86) PCT No.: PCT/EP2017/071289

§ 371 (c)(1),
(2) Date: Nov. 1, 2019

(87) PCT Pub. No.: WO2018/202320

PCT Pub. Date: Nov. 8, 2018

(65) Prior Publication Data

US 2020/0156816 A1 May 21, 2020

(30) Foreign Application Priority Data

May 2, 2017 (EP) ..... 17305490

(51) Int. Cl.
*B65C 9/04* (2006.01)
*B65C 9/22* (2006.01)
(Continued)

(52) U.S. Cl.
CPC ..... *B65C 9/1826* (2013.01); *B65C 9/22* (2013.01); *B65C 9/46* (2013.01); *B65C 9/04* (2013.01);
(Continued)

(58) Field of Classification Search
None
See application file for complete search history.

(56) References Cited

U.S. PATENT DOCUMENTS 3,554,841 A 1/1971 Wysocki et al.
4,832,774 A 5/1989 DiFrank et al.

FOREIGN PATENT DOCUMENTS

EP 2889238 A1 * 7/2015 ..... B67C 7/0053
GB 2260749 A 4/1993
WO 2007110199 A2 10/2007

OTHER PUBLICATIONS

Machine Translation into English of W02007/110199A2, Klaus, published Oct. 4, 2007; 7 pages. (Year: 2007).*
International search report dated Oct. 25, 2017, 10 pages.

* cited by examiner

*Primary Examiner* — Linda L Gray

(57) ABSTRACT

There is described a labelling machine for applying label sheets onto articles comprising: a web feeding unit for feeding a web of labelling material formed by a series of label sheets joined to each other; a label transfer device receiving said web from the web feeding unit at an input station and adapted to feed single label sheets to respective articles at an application station spaced apart from the input station; and a cutting device for cutting the web of labelling material into single label sheets; the label transfer device comprises a transfer conveyor adapted to retain the single label sheets and to release the single label sheets themselves on the articles at the application station; the transfer conveyor comprises a closed-loop transfer track and at least two label holders movable on the transfer track by means of a magnetic-inductive interaction.

16 Claims, 7 Drawing Sheets

(51) Int. Cl.
*B65C 9/46* (2006.01)
*B65C 9/18* (2006.01)

(52) U.S. Cl.
CPC ..... *B65C 9/1803* (2013.01); *B65C 9/1815* (2013.01); *Y10T 156/1339* (2015.01)

LABELLING MACHINE FOR APPLYING LABEL SHEETS ONTO ARTICLES

TECHNICAL FIELD

The present invention relates to a labelling machine for applying label sheets onto articles.

BACKGROUND ART

As it is generally known, the packaging of food or non-food products into respective articles, such as containers, bottles, receptacles and the like, comes along with a labelling of the articles by means of respective label sheets, in particular paper or plastic label sheets, during a labelling process run with a labelling machine.

In one common kind of labelling machine, the articles are driven by a conveying carrousel along a predetermined path, or track, which guides the articles towards an application station, at which each label sheet is put onto the respective article.

Thus, such labelling machines are used to transport, prepare and apply label sheets to containers, bottles, or articles of all sort.

Typically used with beverage bottles or vessels are tubular label sheets (commonly called "sleeve labels"), which are obtained by:

- cutting the web of labelling material, previously unwound from a supply reel, into a plurality of rectangular or square label sheets;
- bending each label sheet in a cylindrical configuration such that the opposite vertical edges overlap one another; and
- welding the overlapped edges of each cylindrical label sheet, the latter resulting in a tube-shaped sheet.

Also widespread used are gluing label sheets, which, after being cut from a web at an appropriate length, are glued by gluing means, such as a gluing roller, spray and injector system or the like, and are finally transferred to respective containers or articles.

In both cases, the label sheets are retained on a vacuum drum by suction.

In particular, a conventional vacuum drum presents an outer lateral surface having an approximately cylindrical lobed configuration; the vacuum drum normally receives, on its outer lateral surface a succession of label sheets at an input station and, after a given rotation about its axis, transfers the label sheets to the labelling machine at the application station so that they can be applied to respective articles or containers.

More specifically, the outer lateral surface of the vacuum drum comprises two or more sections, which are equally spaced angularly from each other around the vacuum drum axis, are provided with a series of ports and are adapted to cooperate in use with respective label sheets.

Each section is delimited, at the opposite angular ends, by respective damping pads, which are carried on the periphery of the vacuum drum at angularly spaced regions thereof, slightly protrude from the outer lateral surface and have the function to engage in use with the leading and the trailing end portions of the label sheets to be transferred, respectively. To this purpose, the pads are provided with a plurality of ports.

In practice, the pads define the zones of the periphery of the vacuum drum where the label sheet transfers occur.

The distance between each pad and the relative upstream pad is thus equal to the length of the label sheet to be processed.

The vacuum drum retains the label sheets, already pre-cut by a rotating knife, using suction through its ports; this suction determines a negative pressure on the label sheets, which are thus retained on the outer lateral surface of the vacuum drum. Then, in the case of gluing label sheets, each label sheet is soaked with glue by means of a gluing roller; once arrived at the application station, the label sheet is released from the vacuum drum by applying a positive pressure through the ports concerned and then stuck onto the article to be labelled.

Typically, the web is wounded on a storing reel and is brought from the reel to the vacuum drum by means of a plurality of rollers and other support units for tensioning and supporting the web when being advanced. This results in a complex system with many components which could, in certain cases, lower the overall reliability of the machine.

The vacuum drum is usually fabricated from a monolithic aluminum casting and it tends to have a structure of high complexity. The drum happens also to be very heavy to handle during fabrication.

Another drawback of this solution is seen in managing the replacement of reels, in particular the splicing of the webs of labelling material when a reel is exhausted, a process which requires an high level of complexity to be automatized.

A further drawback is seen in switching to a different product to be labelled: in this case, the web of labelling material has to be changed, and, thus, the vacuum drum has to be replaced by a new one, suitable for the new product and the new web characteristics.

An even further drawback is seen in the need of an operator passing the web around all the rollers during the splicing of the web itself prior to the activation of the labelling machine. Such a process is prone to errors with respect to the actual path of the web. Moreover, both the overall time and costs needed increase.

DISCLOSURE OF INVENTION

It is an object of the present invention to provide a labelling machine for applying label sheets onto articles, which allows to overcome at least one of the above-mentioned drawbacks in a straightforward and low-cost manner.

This object is achieved by a labelling machine as claimed in claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
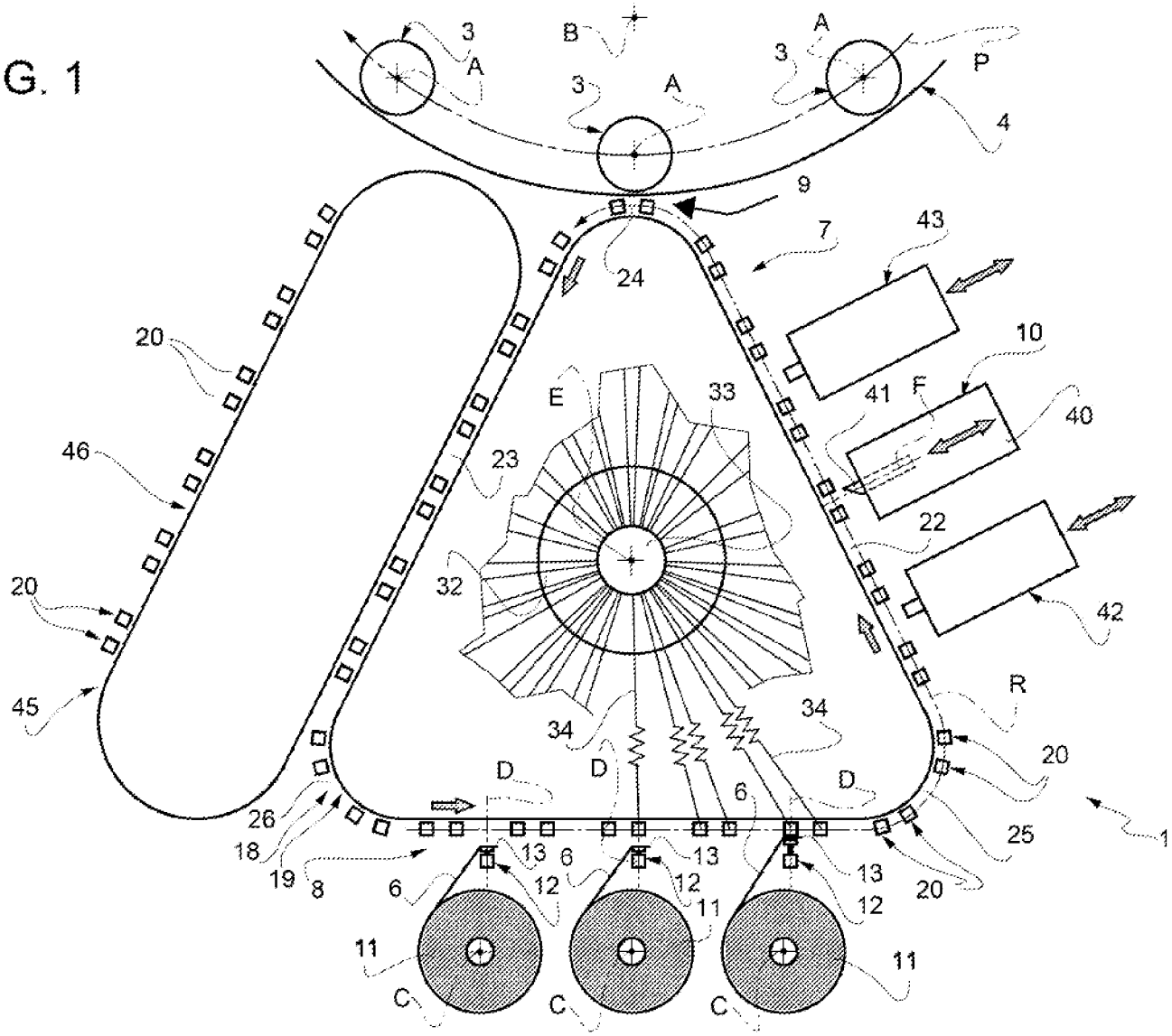
FIG. 1 shows a schematic top plan view of a labelling machine in accordance with the teachings of the present invention.
Figure 5:
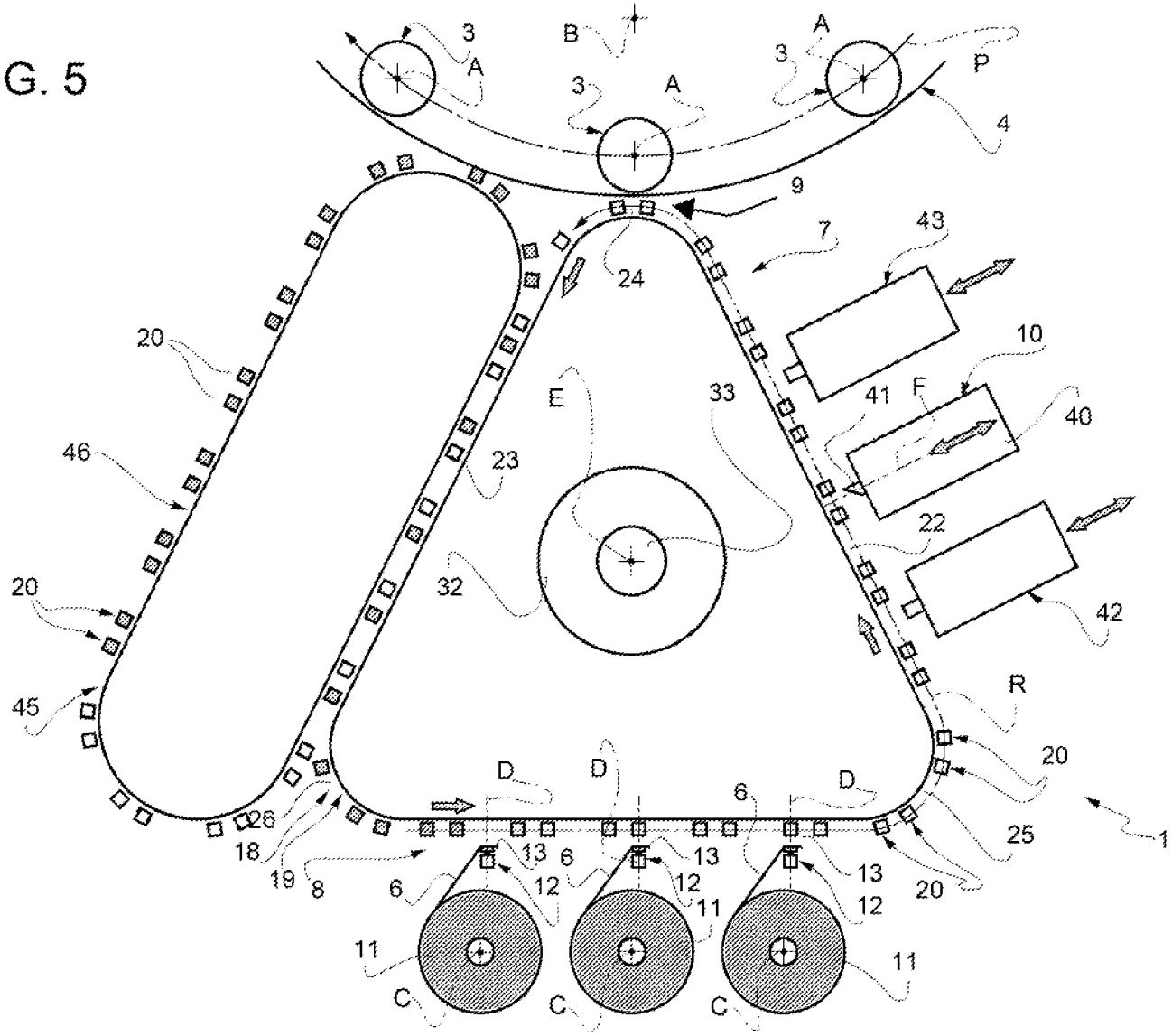
FIG. 5 shows a schematic top plan view of the FIG. 1 labelling machine in a particular condition of use.

With reference to FIGS. 1 and 5, number 1 indicates as a whole a labelling machine adapted to be used for applying label sheets 2 (FIG. 3) onto articles 3, such as containers or bottles, only schematically shown and having respective axes A.

In particular, labelling machine 1 is adapted to apply the label sheets 2 onto respective articles 3 as the latter ones are advanced in known manner along a path P by a conveyor, preferably a carousel conveyor 4.

In the example shown, carousel conveyor 4 is mounted to rotate continuously (clockwise in FIGS. 1 and 5) about a respective vertical axis B perpendicular to the plane of FIGS. 1 and 5; articles 3 are carried by conveyor 4 with their axes A parallel to axis B and are advanced along path P, which is defined by an arc of circumference extending horizontally about the axis B itself.

Labelling machine 1 basically comprises:

a web feeding unit 5;

a label transfer device 7 receiving a web 6 of labelling material from the web feeding unit 5 at an input station 8 and adapted to transfer label sheets 2 to carousel conveyor 4 at an application station 9, spaced apart from the input station 8 itself; and a cutting device 10 for cutting the web 6 of labelling material, retained by label transfer device 7, in single label sheets 2.

Label transfer device 7 is arranged on one side of carousel conveyor 4 and is adjacent to the latter at application station 9, so that label sheets 2 can be transferred from the label transfer device 7 itself to each one of the articles 3 advancing on the carousel conveyor 4.

Web feeding unit 5 is arranged on the opposite side of label transfer device 7 with respect to carousel conveyor 4 and is adjacent to the label transfer device 7 itself at input station 8.

Figure 4:
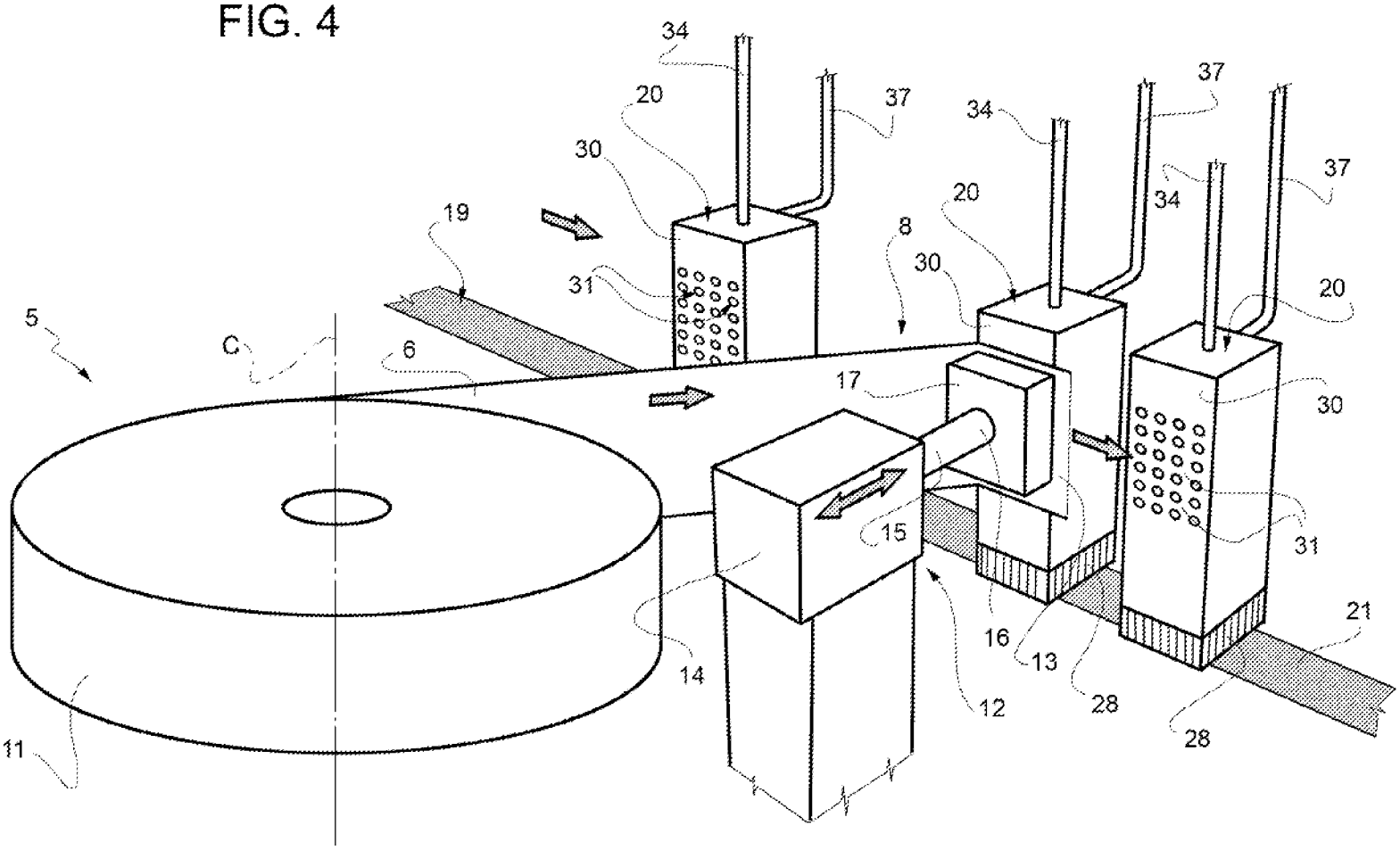
FIG. 4 shows a larger-scale perspective view of a reel storage unit of the FIG. 1 labelling machine.

With reference to FIGS. 1, 4 and 5, web feeding unit 5 comprises a plurality of reels 11 of web 6 of labelling material, placed facing input station 8 of label transfer device 7 and having respective axes C extending vertically and parallel to axes A and B. In particular, reels 11 are aligned in one single horizontal row facing label transfer device 7.

In the example shown, web 6 is formed by a series of label sheets 2 joined to each other, which have rectangular or square shapes and are obtained by cutting the web 6 itself, initially wound on one respective reel 11, by means of cutting device 10.

Web feeding unit 5 further comprises, for each reel 11, a respective feeding actuator 12 coupled in a releasable way to a leading portion 13 of the respective web 6 and which is selectively operated to move towards and away from the label transfer device 7 so as to feed the web 6 to the label transfer device 7 itself.

In the specific embodiment shown in FIGS. 1, 4 and 5, each feeding actuator 12 comprises a fixed casing 14, placed on one side of the respective reel 11, and a piston 15 reciprocally movable through casing 14 towards and away from input station 8 of label transfer device 7 and along a respective horizontal axis D, orthogonal to axes A, B, C.

In practice, feeding actuators 12 are selectively operated to transfer webs 6, unwound from the respective reels 11, to input station 8 of label transfer device 7.

Each piston 15 has, at its free axial end 16, a plate 17 equipped with a plurality of ports (not shown), selectively supplied with vacuum, for retaining the leading portion 13 of the respective web 6 of labelling material during its transfer from the respective reel 11 to input station 8 of label transfer device 7.

During transfer of one web 6 to label transfer device 7, release of leading portion 13 of the web 6 itself is achieved by simply interrupting the connection of the ports of the respective plate 17 to vacuum.

With reference to FIGS. 1, 2, 3 and 5, label transfer device 7 comprises an endless transfer conveyor 18, which is adapted to retain and advance the web 6 of labelling material received from web feeding unit 5 and, once the web 6 has been cut by cutting device 10, it is adapted to retain, advance and release the deriving label sheets 2 by means of pressure.

According to an important aspect of the present invention, conveyor 18 is of linear-motor type and comprises a closed-loop transfer track 19, and a plurality of label holders or carts 20 movable along track 19 by means of a magnetic-inductive interaction and apt to cooperate with the web 6 and the label sheets 2 to transfer them from input station 8 to application station 9.

In particular, carts 20 are independently controlled and moved along track 19; as illustrated in FIGS. 1 and 5, track 19 defines a closed-loop magnetic-inductive path R for carts 20. In the example shown, track 19 extends horizontally and coplanar with path P of carousel conveyor 4.

Preferably, track 19 has a substantially triangular shape and comprises three rectilinear branches 21, 22, 23 connected with each other by three curved vertex portions 24, 25, 26.

In particular, application station 9 is arranged in correspondence of vertex 24 of track 19 and is substantially tangent to carousel conveyor 4; input station 8 is arranged in correspondence of branch 21, which is opposite to vertex 24 and is also orthogonal to axes D; cutting device 10 is arranged facing branch 22, this latter being arranged downstream of input station 8 and upstream of application station 9 following path R. In other words, branch 22 is comprised between vertices 24 and 25, branch 23 is comprised between vertices 24 and 26 and branch 21 is comprised between vertices 25 and 26.

In the preferred embodiment shown in the enclosed figures, track 19 houses a stator armature formed by a plurality of individually-excitable solenoids 27 (known per se and only schematically shown in FIG. 2), and carts 20 house respective permanent magnets 28 (known per se and only schematically shown in FIGS. 2 to 4); carts 20 are independently moved along track 19 by individually controlling the solenoids 27.

According to a possible alternative not shown, track 19 may be also provided with the permanent magnets and carts 20 may house the individually-excitable solenoids.

In this preferred embodiment, carts 20 have prismatic shapes and present, on their front faces 30, respective ports 31 which can be alternatively used to produce suction or a positive pressure on the respective web 6 or label sheet 2.

Figure 3:
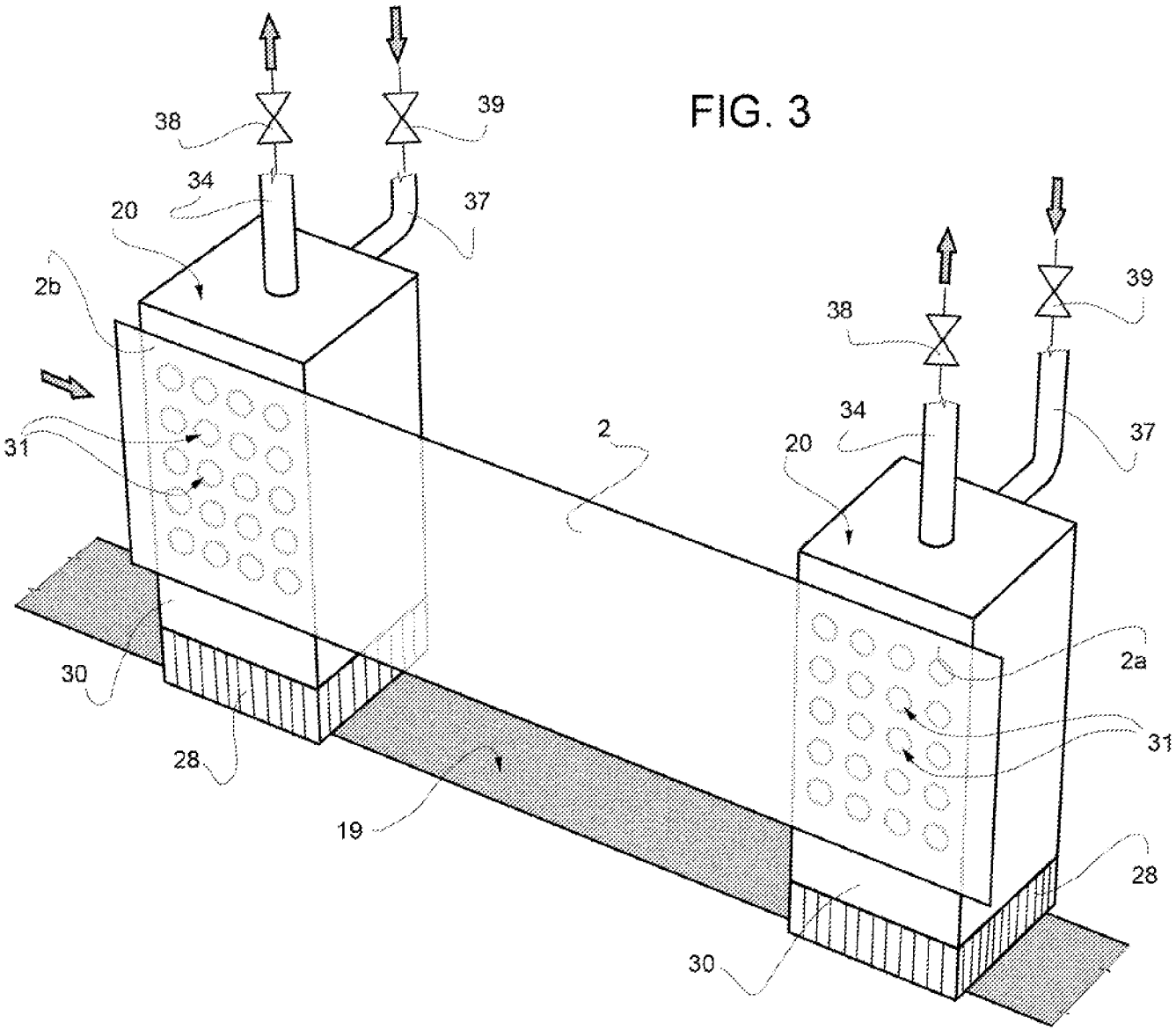
FIG. 3 shows a larger-scale perspective view of a detail of FIG. 2.

As shown in FIG. 3, carts 20 cooperate in pairs with respective label sheets 2; in other words, by considering the advancing direction of carts 20 along path R, each label sheet 2 has a leading portion 2*a*, retained by the leading cart 20 of the respective pair, and a trailing portion 2*b*, retained by the trailing cart 20 of such pair.

Figure 2:
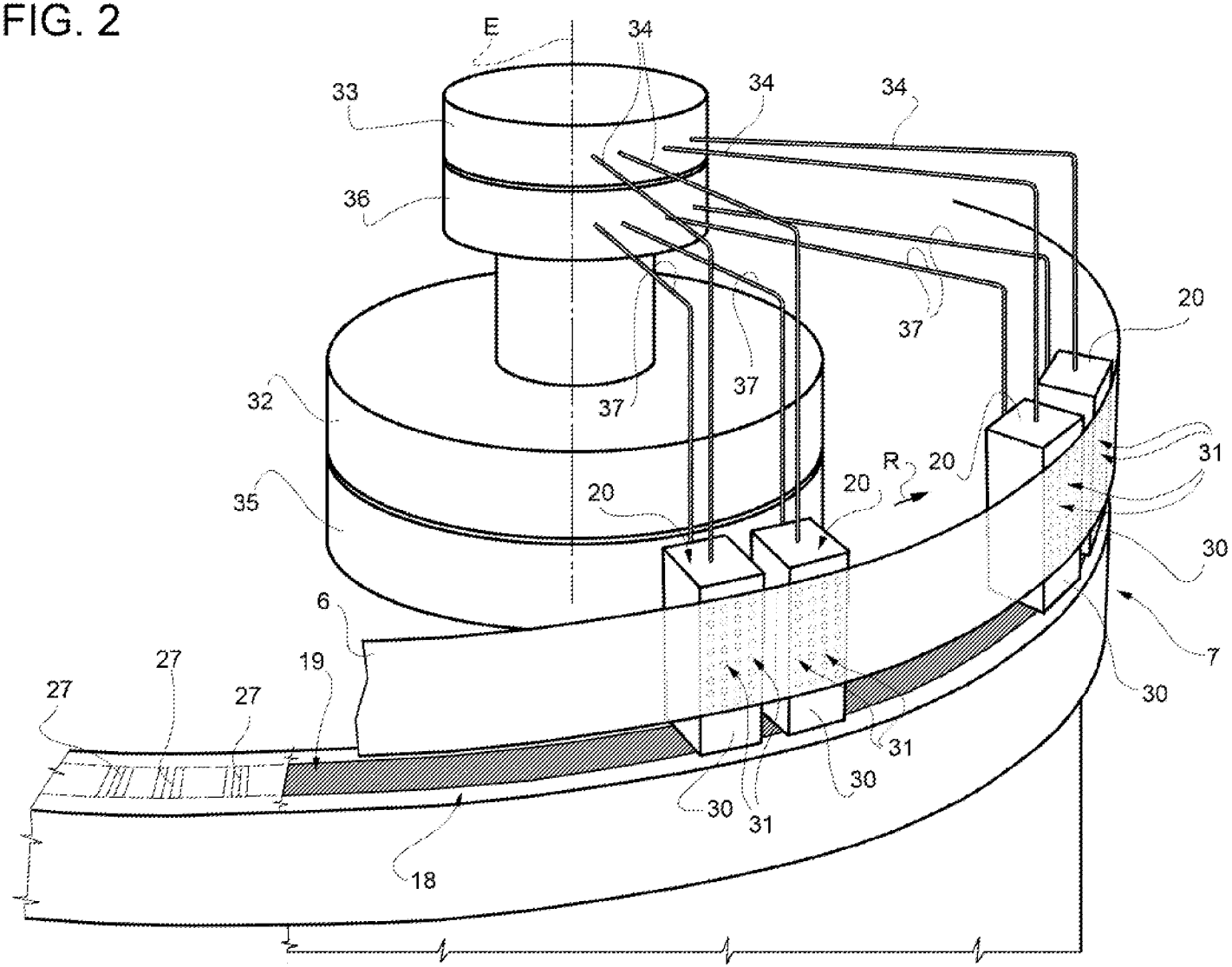
FIG. 2 shows a larger-scale perspective view of a portion of the FIG. 1 labelling machine.

With particular reference to FIGS. 1, 2 and 5, label transfer device 7 further comprises a first annular rotating tank 32, connected in a known manner to a vacuum source (not shown), such as a vacuum pump, and a first rotating distributor 33, connected on one side to the tank 32 and the vacuum source and on another side to each cart 20 by a respective pipe 34.

Label transfer device 7 also comprises a second annular rotating tank 35, connected in a known manner to a compressor (not shown), and a second rotating distributor 36, connected on one side to the tank 35 and the compressor and on another side to each cart 20 by a respective pipe 37.

Tanks 32, 35 and distributors 33, 36 are all mounted to rotate about a common vertical axis E parallel to axes A, B and C. In addition, tanks 32, 35 and distributors 33, 36 are arranged substantially in the central area delimited by track 19 and are stacked up on each other.

As visible in FIG. 3, each pipe 34, 37 is provided with an ON/OFF valve 38, 39 to enable or disable connection of the respective cart 20 with either distributor 33 or distributor 36.

As visible in FIGS. 1 and 5, cutting device 10 is placed in a position facing branch 22 of track 19, i.e. in a position interposed between input station 8 and application station 9; cutting device 10 basically includes a fixed casing 40 and a knife 41 movable through casing 40 along an axis F, orthogonal to the branch 22 itself so as to interact with web 6 and cut it into single label sheets 2.

Labelling machine 1 further comprises a printing device 42 (known per se and only schematically shown) for printing given patterns or bar codes on label sheets 2, and a gluing device 43 (known per se and only schematically shown), e.g. a glue sprayer, for applying glue to label sheets 2.

In this particular preferred embodiment, printing device 42, cutting device 10, and gluing device 43 are all placed in front of branch 22 of track 19 and are arranged in series with respect to the direction of motion of carts 20 along path R; in practice, cutting device 10 is placed between the printing device 42 and gluing device 43, the printing device 42 being placed upstream of the others.

Labelling machine 1 advantageously also comprises a closed-loop service conveyor 45 arranged laterally with respect to conveyor 18 in front of branch 23 of track 19 and adapted to selectively receive carts 20 from label transfer device 7 for cleaning and/or maintenance thereof or adapted to selectively replace carts 20 with others of different type in case of switching of label format.

In particular, service conveyor 45 is of linear-motor type and comprises a closed-loop service track 46, equipped with a plurality of individually-excitable solenoids (identical to solenoids 27 and not shown).

Tracks 19 and 46 have branch 23 in common, along which carts 20 can be exchanged between the tracks 19, 46 themselves when production is stopped.

In particular (FIG. 5), in case of change of label format, by appropriately controlling and operating conveyors 18, 45, it is possible to replace the carts 20 currently in use (shown in white in FIG. 5) with new ones (shown in grey in FIG. 5) suitable for the new label format.

The operation of labelling machine 1 is described hereafter starting from the condition of FIG. 1, in which the web 6 of one reel 11 is being fed to label transfer device 7 at input station 8, whilst the webs 6 of the other reels 11 are maintained detached from the input station 8 itself.

In particular, in this condition, piston 15 of the feeding actuator 12 carrying the web 6 to be fed to label transfer device 7 is set in an advanced position along its axis D, in which its respective plate 17 brings the leading portion 13 of the web 6 itself into contact with one selected cart 20 of conveyor 18; pistons 15 of the other feeding actuators 12 are coupled to respective leading portions 13 of the other webs 6 and are all maintained in retracted positions along their axes D, in which their plates 17 are spaced and detached from path R followed by carts 20. As leading portion 13 of the selected web 6 contacts the selected cart 20, connection of the ports of the respective plate 17 to vacuum is cut, whilst connection of the cart 20 itself to the vacuum source is activated by opening the valve 38 on the respective pipe 34.

In this way, leading portion 13 of the selected web 6 is dragged by the above-identified cart 20 along track 19 and path R; the web 6 of labelling material is, thus, continuously unwound from the respective reel 11 and advanced towards application station 9.

Each label sheet 2 forming the web 6 in use progressively adheres at its leading and trailing portions 2*a*, 2*b* to respective carts 20, which retain the label sheet 2 itself by means of suction acting through the respective ports 31.

By proceeding along path R, web 6 is first printed at each label sheet 2 with given patterns and/or bar codes by printing device 42.

Then, the web 6 is cut into single label sheets 2 by reciprocal movement of knife 41 of cutting device 10 along axis F.

At this point, label sheets 2 are sprinkled with glue by gluing device 43. Each label sheet 2 is subsequently released from the respective pair of carts 20 at application station 9 by progressively cutting vacuum and activating positive pressure on the label sheet 2 itself.

In particular, by controlling the respective valves 38, 39 vacuum is progressively cut on each cart 20 and positive pressure is progressively activated to enable transfer of the respective label sheet 2 on the corresponding article 3 simultaneously advancing along carousel conveyor 4 and rotating on its axis A in known manner.

Carts 20, which have already released the respective label sheets 2, can conveniently be controlled to move along track 19 faster than the ones still holding label sheets 2, until reaching again input station 8.

Carts 20 that need to be replaced, cleaned or subjected to maintenance are conveniently and selectively directed to service conveyor 45 through common branch 23, by controlling solenoids 27 of tracks 19 and 46, when the production is stopped.

In this particular condition, carts 20 in use are preventively disconnected from respective pipes 34, 37 and the new or cleaned carts 20 entering track 19 need to be connected to such pipes 34, 37 prior to starting production.

When the reel 11 in use is exhausted, production can be continued by simply activating one of the other feeding actuators 12 so as to feed the leading portion 13 of the respective web 6 to a selected cart 20.

Figure 3A:
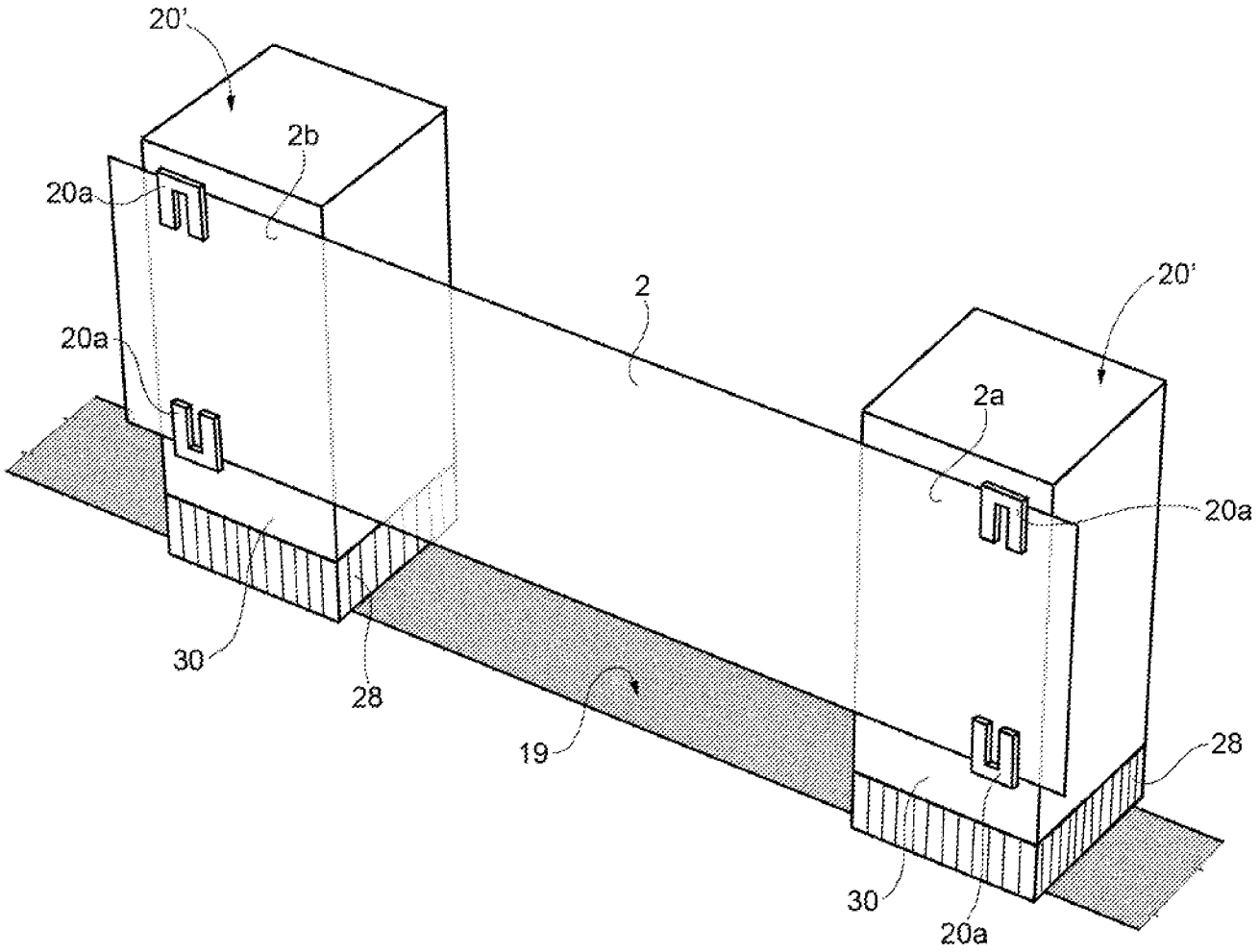
FIGS. 3*a* and 3*b* are analogous to FIG. 3 and show possible alternative solutions for the detail of FIG. 2.

The variant of FIG. 3*a* shows one possible alternative solution of carts 20' to be used in labelling machine 1; carts 20' are similar to carts 20 and will be described hereafter only insofar as they differ from the carts 20 themselves and by using the same reference numerals for parts equal or equivalent to those already described.

In this case, each label sheet 2, either being part of the web 6 or being separated from the web 6 itself, is retained on a respective pair of carts 20' by grippers 20*a*.

In particular, each cart 20' is provided, on its top and bottom parts, with respective grippers 20*a* cooperating with the leading or trailing portion 2*a*, 2*b* of the respective label sheet 2.

Grippers 20*a* of carts 20' replace suction or positive pressure used on carts 20. Grippers 20*a* are mounted on their respective carts 20' in a movable way so as to release the leading or trailing portion 2*a*, 2*b* of the respective label sheet 2 at application station 9.

Figure 3B:
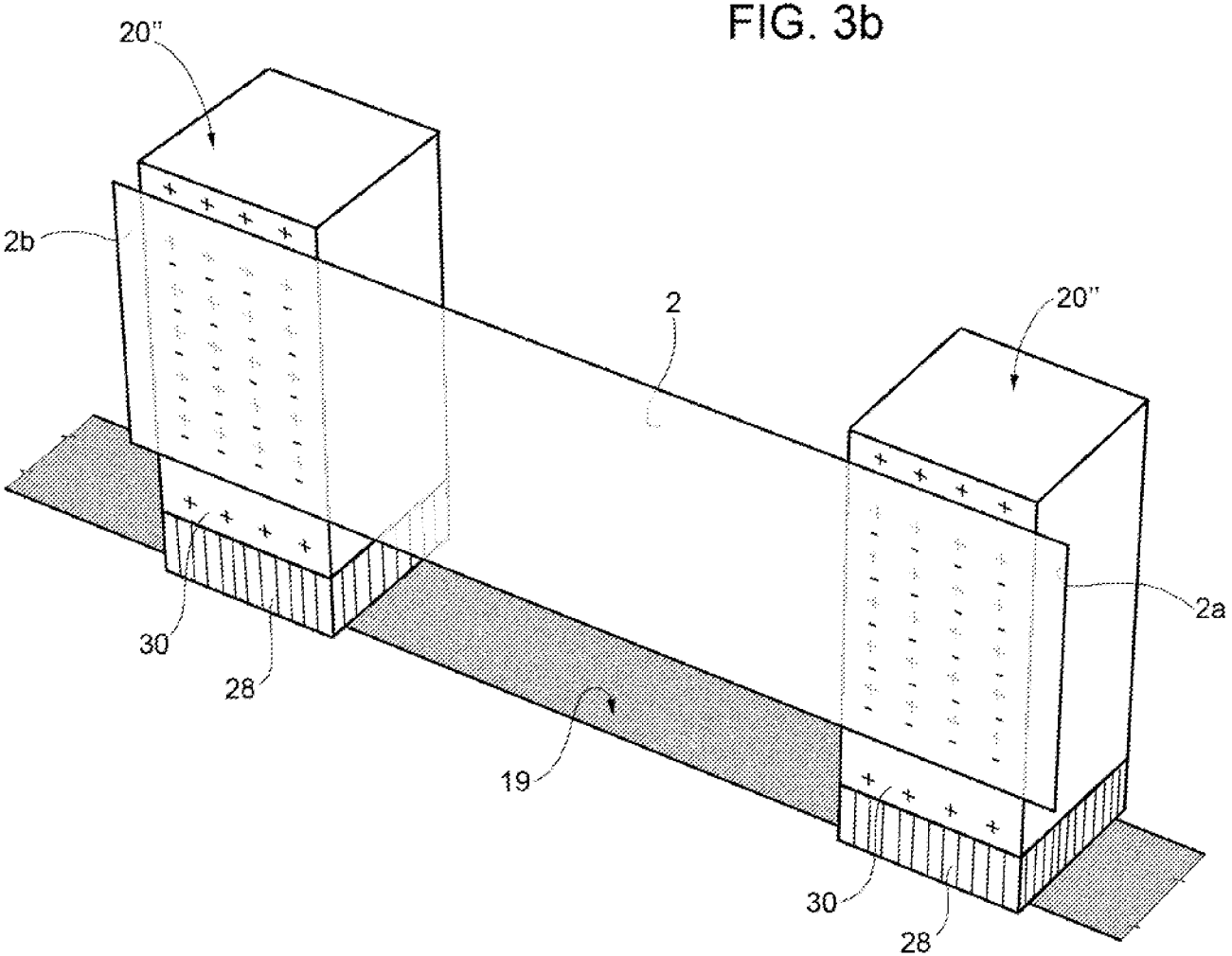

The variant of FIG. 3*b* shows one further possible alternative solution of carts 20" to be used in labelling machine 1; carts 20" are similar to carts 20 and will be described hereafter only insofar as they differ from the carts 20 themselves and by using the same reference numerals for parts equal or equivalent to those already described.

In this case, label sheets 2 are electrostatically charged with a negative or positive charge—in the example shown with a negative charge—and carts 20" are electrostatically charged with a positive or negative charge—in the example shown with a positive charge. In practice, carts 20" and label sheets 2 are electrostatically charged with opposite charges.

In this way, each label 2, either being part of web 6 or being separated from the web 6 itself, is retained on the respective pair of carts 20" only by means of static electricity, with no need to use suction.

In the light of the above, the present invention provides a new labelling machine 1, which significantly improves the process of applying label sheets 2 onto articles 3.

This effect is obtained by introducing a magnetic-inductive control of the label transfer device 7, wherein carts 20, 20', 20" can independently move along track 19, so resulting in a more time-efficient labelling process. More specifically, after releasing the label sheets 2 onto the respective articles 3, carts 20, 20', 20" can be accelerated conveniently while returning to the input station 8 of the label transfer device 7, where they receive again the web 6 of labelling material from the respective reel 11.

Furthermore, the web feeding unit 5 as described in this solution provides a simple and continuous supply of labelling material, overcoming some of the drawbacks above mentioned, e.g. the splicing of webs and the need for an operator passing the web around all the rollers during the splicing itself. In fact, the reels 11 are advantageously organized in a way such that when a reel 11 is exhausted, another one is ready to deliver another respective web 6 of labelling material to the carts 20, 20', 20" by simply activating the respective feeding actuator 12, as described above.

The introduction of the service conveyor 45, also equipped with its own inductive track 46, significantly eases the process of maintenance of carts 20, 20', 20"", reducing overall time consumption and costs.

Last but not least, the labelling machine according to the present invention allows a more flexible switch between different products and, thus, different label formats: in fact, when a different format of label sheet 2 has to be applied, it is sufficient to replace the old carts 20, 20', 20" with new appropriate carts 20, 20', 20" suitable for the new label sheet 2 and the new web characteristics.

Clearly, changes may be made to the labelling machine 1 as described and illustrated herein, without, however, departing from the scope of protection as defined in the accompanying claims.

The invention claimed is:

1. A labelling machine (1) for applying label sheets (2) onto articles (3) comprising:

a web feeding unit (5) for feeding a web (6) of labelling material formed by a series of label sheets (2) joined to each other;

a label transfer device (7) receiving said web (6) from said web feeding unit (5) at an input station (8) and adapted to feed single label sheets (2) to respective articles (3) at an application station (9) spaced apart from said input station (8); and a cutting device (10) for cutting said web (6) of labelling material into said single label sheets (2);

said label transfer device (7) comprising a transfer conveyor (18) adapted to retain said web (2) and said single label sheets, and to release the single label sheets (2) themselves on said articles (3) at said application station (9);

wherein said transfer conveyor (18) comprises a closed-loop transfer track (19), and at least two label holders (20, 20', 20") movable on said transfer track (19) by means of a magnetic-inductive interaction.

2. The labelling machine as claimed in claim 1, wherein said magnetic-inductive interaction is established between individually-excitable solenoids (27) and permanent magnets (28).

3. The labelling machine as claimed in claim 2, wherein said transfer track (19) comprises a plurality of said individually-excitable solenoids (27) defining a closed-loop magnetic-inductive path (R) for said label holders (20, 20', 20"), and wherein said label holders (20, 20', 20") carry said permanent magnets (28).

4. The labelling machine as claimed in claim 1, wherein said label holders (20, 20', 20") are independently controlled to move along said transfer track (19).

5. The labelling machine as claimed in claim 1, wherein said transfer conveyor (18) is configured to retain said web and said single label sheets (2) by means of suction.

6. The labelling machine as claimed in claim 5, wherein said label transfer device (7) further comprises a first rotating distributor (33) arranged in an area delimited by said transfer track (19), fed by a vacuum source and connected to said label holders (20) through respective pipes (34) and valves (38) to selectively provide suction for retaining the web (6) of labelling material and said single label sheets (2) on said label holders (20) during transfer from said input station (8) to said application station (9).

7. The labelling machine as claimed in claim 1, wherein said label transfer device (7) further comprises a second rotating distributor (36) arranged in an area delimited by said transfer track (19), fed by a compressor and connected to said label holders (20) through respective pipes (37) and valves (39) to selectively provide a positive pressure on said single label sheets (2) to release them from said label holders (20) at said application station (9).

8. The labelling machine as claimed in claim 1, wherein said label holders (20') comprise releasable grippers (20*a*) to retain in a releasable manner said web and said single label sheets (2) on said transfer conveyor (18).

9. The labelling machine as claimed in claim 1, wherein said label holders (20") and said single label sheets (2) are electrostatically charged with opposite charges so that said web and said single label sheets (2) are retained on said transfer conveyor (18) electrostatically.

10. The labelling machine as claimed in claim 1, wherein said cutting device (10) is arranged facing said transfer track (19) between said input station (8) and said application station (9).

11. The labelling machine as claimed in claim 1, further comprising a printing device (42) for printing given patterns and/or bar codes on the labelling material advanced by said label transfer device (7); said printing device (42) being arranged facing said transfer track (19) between said input station (8) and said application station (9).

12. The labelling machine as claimed in claim 11, wherein said printing device (42) is arranged upstream of said cutting device (10) with respect to a direction of motion of said label holders (20, 20', 20").

13. The labelling machine as claimed in claim 1, further comprising a gluing device (43) for applying glue on said labelling material advanced by said label transfer device (7); said gluing device (43) being arranged facing said transfer track (19) between said input station (8) and said application station (9).

14. The labelling machine as claimed in claim 13, wherein said gluing device (43) is arranged downstream of said cutting device (10) with respect to a direction of motion of said label holders (20, 20', 20"), to apply glue on each label sheet (2).

15. The labelling machine as claimed in claim 1, wherein said web feeding unit (5) comprises a plurality of reels (11) of said web (6) of labelling material, placed in front of said label transfer device (7), and, for each of said reels (11), a respective feeding actuator (12) coupled in a releasable way to a leading portion of the respective web (6) of labelling material and which is selectively operated to move towards and away from the label transfer device (7) so as to feed the web (6) itself to said label transfer device (7).

16. The labelling machine as claimed in claim 1, wherein said transfer conveyor (18) comprises a plurality of said label holders (20, 20', 20") cooperating in pairs with respective said single label sheets (2), during transfer to said application station (9), each of said single label sheets (2) having a leading portion (2*a*), retained by a leading label holder (20, 20', 20") of a respective pair of label holders (20, 20', 20"), and a trailing portion (2*b*) retained by a trailing label holder (20, 20', 20") of the respective pair.

* * * * *